United States Patent [19]

Poon

[11] Patent Number: 4,586,200

[45] Date of Patent: May 6, 1986

[54] PROTECTIVE CRASH HELMET

[76] Inventor: Melvyn C. Poon, 130 Vasquez St., San Francisco, Calif. 94127

[21] Appl. No.: 593,550

[22] Filed: Mar. 26, 1984

[51] Int. Cl.[4] ..... A42B 3/02

[52] U.S. Cl. ..... 2/413; 2/414; 2/424

[58] Field of Search ..... 2/413, 412, 424, 425, 2/414

[56] References Cited

U.S. PATENT DOCUMENTS

| | | | |
|---|---|---|---|
| 3,600,714 | 8/1971 | Cade et al. | 2/413 X |
| 3,609,764 | 10/1971 | Morgan | 2/414 |
| 3,860,966 | 1/1975 | Brown | 2/415 |
| 3,925,821 | 12/1975 | Lewicki | 2/425 |
| 3,999,220 | 12/1976 | Keltner | 2/413 |
| 4,038,700 | 8/1977 | Györy | 2/413 |
| 4,054,953 | 10/1977 | De Barsy | 2/414 |
| 4,081,865 | 4/1978 | Bergee et al. | 2/425 |
| 4,115,874 | 9/1978 | Hasegawa | 2/425 |
| 4,141,085 | 2/1979 | Adams | 2/424 X |

OTHER PUBLICATIONS

Dan River, *A Dictionary of Textile Terms,* 12th Edition, 1976, p. 109, "Textile".

*Primary Examiner*—Werner H. Schroeder
*Assistant Examiner*—J. L. Olds
*Attorney, Agent, or Firm*—Howard A. Kenyon

[57] ABSTRACT

A protective crash helmet designed to increase the safety and comfort of a motorcycle rider is described. One of the protective layers inside the helmet includes inflatable air bubbles whose pressure and consequently size may vary when connected to an outside air pressure supply. This unique feature allows a more precise fit to a rider's head, all of which are not the same shape. In addition, the protective crash helmet also has a ventilating system for cooling the interior of the crash helmet. An air inlet located on the front of the helmet with a valving door, allows air inside the helmet whereby the passageway is the space between the respective air bubbles. The air outlet located in the rear of the helmet allows the air to pass through the helmet thereby cooling the rider.

8 Claims, 7 Drawing Figures

A-A

PROTECTIVE CRASH HELMET

BACKGROUND OF THE INVENTION

1. Field of the Invention

This invention relates in general to a protective crash helmet and more specifically to a protective crash helmet that increases the safety and comfort of the wearer.

2. Description of the Prior Art

The standard helmet worn today by motorcycle riders usually contains three (3) basic layers. The outside layer is a shell made of impact resistant material, the next layer beneath the shell is a relatively thick cushioning material and the inner layer is a thin liner backed with open cell foam.

The standard helmet is also provided in sizes similar to hat sizes, however, some interior portions of the helmet may allow a gap between between the wearer's head and the liner. The reason for the gap is because all wearer's heads are not the same shape. Some wearers may have a gap at the top or side while others may have the gap on the front or back. In case of a crash, the wearer's head would have to take up the gap before the cushioning material would take affect. This could create injury to the wearer in a high impact crash where all the cushioning effect is required.

A standard helmet being constructed for safety is also thermally insulated, and can cause discomfort as a result of high ambient temperature. In warm weather, these helmets become quite uncomfortable due to the fact that only the wearer's face is exposed to the exterior air and then only when certain types of face shields or no face shields at all are used. Thus in summer, especially when the temperature inside the helmet increases, the head of the wearer gets moist. Therefore, even if the wearer wears the helmet for a short time, the wearer feels uncomfortable.

There are several safety helmets that combine a cushioning effect with a ventilating system available as prior art. One such helmet is U.S. Pat. No. 3,860,966 to Brown. This helmet is designed in two (2) sections that pivot to avoid injury to the back of the wearer's neck. A ventilating system is also included. This invention concentrates on protecting the wearer's neck during high impact accidents. The section described in this invention that pivots is designed to engage the wearer's neck at a point below the fragile upper cervical area and in particular below the third vertebrae. While this invention may provide additional safety if the neck portion becomes involved in a crash, there is no adjustable layer to provide a snug and therefore a safer fit on the wearer's head.

Another protective helmet and ventilating system is described in U.S. Pat. No. 4,081,865 to Bergee et al. This helmet is again comprised of a rigid outer shell, a liner of suitable cushioning material and a thin inner liner covering the cushioning material. The ventilating system is a complex air flow pattern over the wearer's head with adjustable doors in front of the helmet to control the air flow. Again, there is no teaching of an adjustable liner to provide safety and comfort.

A third reference to crash helmets is U.S. Pat. No. 4,054,953 to DeBarsy which also describes a ventilating system. DeBarsy's patent also describes a solid shell, a inwardly lined compressible material, and a thin layer of open-cell foam. The air from the ventilating system enters the top front of the helmet, is circulated and exits the rear. DeBarsy does not describe an adjustable liner to provide a more safe and comfortable fit.

It will be seen from the following description of the present invention that the present invention overcomes the shortcomings of the above helmets by providing a means to adjust the inner liner to fit various head shapes. This not only provides comfort but safety to the wearer. In addition, an adjustable ventilating system is provided to give the wearer additional comfort, especially in warm weather. The present invention's adjustable layer of air bubbles can be tailored by air pressure to fit a specific shaped head. This will not allow any gap between the wearer's head and the liners. In addition, by using a special shaped air bubble, air may circulate over the wearer's head from an entrance door in the front of the helmet and exit through doors in the rear of the helmet. In order to insure a snug fit, the air bubbles communicate with each other whereby the pressure in all the air bubbles is substantially the same but the volume will vary.

In the event of an accident where the helmet strikes a hard object, the air bubbles and their respective tubes that allow the air bubbles to communicate with each other will provide a damping effect.

SUMMARY OF THE INVENTION

It is the object of the present invention to provide a protective crash helmet.

it is another object of the present invention to provide a protective crash helmet that can be adjusted to fit any shaped human head.

It is yet another object of the present invention to provide a protective crash helmet with a ventilating system to provide air circulating inside the helmet.

It is still another object of the present invention to provide a protective crash helmet with a ventilating system that can be adjusted to allow more or less air to circulate inside the helmet.

Briefly, there is described a protective crash helmet that provides one of the inner liners with adjustable air bubbles to not only provide superior impact absorbing capability but also provide a comfortable fit to various shaped human heads. In addition, an adjustable ventilating system is described which allows air to circulate between the air bubbles providing yet additional comfort.

These and other objects, features and advantages of the present invention will become more readily apparent upon detailed consideration of the following description of a preferred embodiment with reference to the accompanying drawings.

While the invention will be described in connection with the preferred embodiment, it will be understood that it is not intended to limit the invention to that embodiment. On the contrary, it is intended to cover all alternatives, modifications and equivalents that may be included within the spirit and scope of the invention as defined by the appended claims.

DETAILED DESCRIPTION OF THE INVENTION

Figure 1:
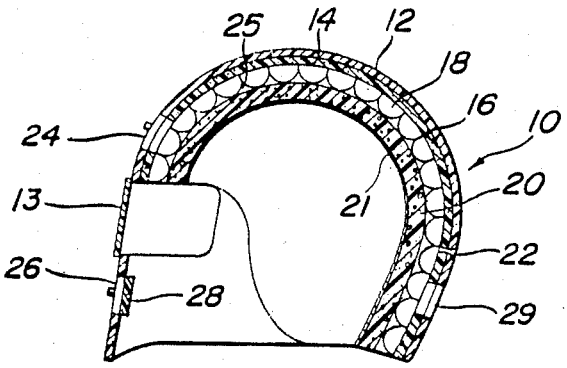
FIG. 1 is a side view cross section of the protective crash helmet showing the various layers of material.

Referring now to FIG. 1, there is shown a side view cross section of the protective crash helmet. FIG. 1 which describes the preferred embodiment generally shown as 10 further shows the layers of material in the protective crash helmet. A hard outer protective shell 12 made of a durable high impact plastic such as resin impregnated fiberglass or polycarbonate is the semispherical portion that covers the top and sides of the wearer's head. A face plate 13 is fabricated from a clear impact resistant plastic that is attached to the outer layer by snaps (not shown). The second layer 14 fitted and secured inside the semispherical shell is a cushioning material such as expanded polystyrene. The third layer 16 consists of hemispherical shaped air bubbles or air cells 18 which are secured to the cushioning material and is the point of novelty. The round portion of the hemispherical shape is directed toward the wearer's head. The fourth layer 20 is a thin layer of porous open cell foam secured to a thin soft cotton or knitted nylon mesh 21 which is next to the wearer's head. The fourth layer 20 may be attached to the round portion of air bubbles 18. However, in the preferred embodiment, the fourth layer 20 is removable to be able to be cleaned when soiled. A plurality of snap fasteners (not shown) between the periphery of the fourth layer 20 and the outer shell 12 is sufficient to hold the fourth liner 20 in place. It has been found that a silicon type glue is most satisfactory when attaching the cushioning material to the outer shell, attaching the layer of air bubbles to the cushioning material and if desired attaching the liner to the air bubbles. The air bubbles 18 communicate with each other by way of small tubes or passageways (not shown) that allow the air pressure to equalize in all the air bubbles 18. This equilization of air pressure allows the present invention to tailor the interior portion of the helmet 10 to fit a wearer's head shape which is unlike any of the prior art. To accomplish this, there is a valving means 22 in the rear of the outer layer 12 which has the same mechanism as a valve on an automobile tire. The supply means which can be a small hand pump (not shown) or an air pressure source is used to pressure the air bubbles 18. The air bubbles 18 are made from layers of polyvinyl sheet in the preferred embodiment, although the air bubbles 18 can be made from any strong flexible material that can expand slightly or sufficiently to conform to the wearer's head. The polyvinyl material must be sufficiently thick to withstand an impact without rupturing yet be sufficiently resilient to expand under pressure to conform to a wearer's head. It has been found that polyvinyl material thickness between 25 mils and 75 mils will provide the safety and resiliency required in the present invention. The inner layer 20 of open cell foam is porous to allow air circulated inside the helmet 10 to reach the wearer's head and provide cooling and hence comfort.

Figure 2:
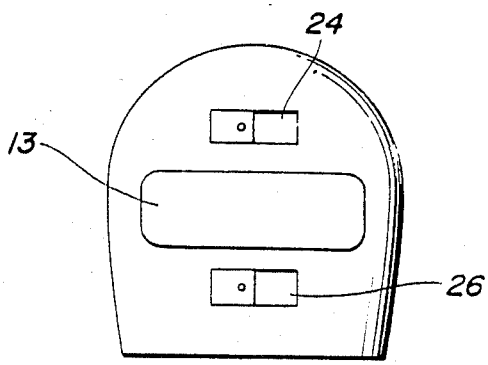
FIG. 2 is a frontal view of the protective crash helmet showing the air inlets.

FIG. 2 shows a ventilating system inlet 24 in the upper front of helmet 10 where the air flow privides a positive pressure when the helmet 10 is moving forward. Also shown is a air inlet 26 in front of the wearer's face to allow the air to cool the nose/mouth area if desired. The air inlet 26 has a disposable mesh filter 28 made from open cell foam shown in FIG. 1 that screens the air for the face region from bugs and undesirable particles. Both inlet 24 and inlet 26 have a door, slidably arranged, that meters the air received through the inlets 24 and 26. The air passing through inlet 24 passes through passageways 25 since the air bubbles 18 are of hemispherical shape which have room for the air to circulate around the sides of the air bubbles 18.

Figure 3:
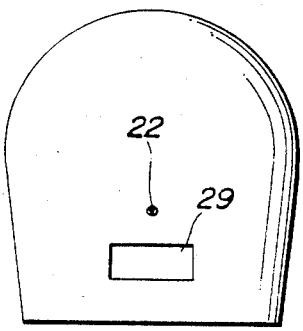
FIG. 3 is a rear view of the protective crash helmet showing the air outlet and air supply valve.

FIG. 3 shows the outlet 29 of the ventilating system. It is noted that the outlet 29 is located in a negative pressure region, when the helmet 10 is moving forward, which will assist the air flow from the outlet 29. Also shown in FIG. 3 is the valving means 22 whereby the air bubbles 18 are pressurized.

Figure 4:
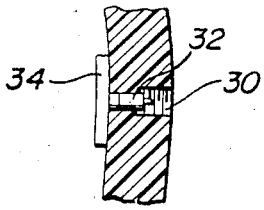
FIG. 4 is a detailed cut-a-way section of the air supply valve.

FIG. 4 shows the valving means, greatly expanded, to provide greater details. A threaded recess 30 is provided to screw in a hand pump, or if air pressure from a source is available, an adapter (not shown) can be threaded into the recess 30 to allow a standard nozzle which is used to fill automobile tires to be used. The valve 32 is a standard valve which is used in automotive, motorcycle, and bicycle tires. The tubes 34 communicate with the air bubbles 18 nearest the valving means 22. Since, as previously stated, the air bubbles 18 communicate with each other by passageways, the entire array of air bubbles can conform to the shape of a wearer's head when pressure is supplied through valve 32.

Figure 5:
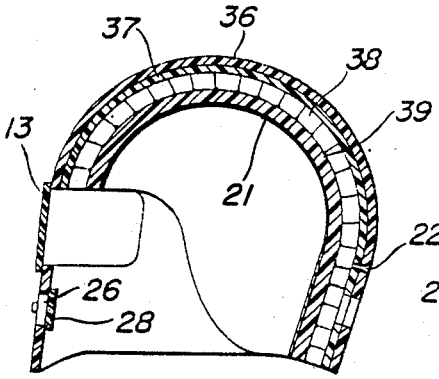
FIG. 5 is a side view cross section of the protective crash helmet showing another embodiment using air bubbles.

FIG. 5 presents another embodiment with layers 36, 37, 38 and 39 identical in composition to layers 12, 14, 16 and 20 respectively of FIG. 1. However, the air bubble layer 38 does not have any air passageways similar to 25 in FIG. 1. The space between layers 37 and 39 is therefore completely filled with the air bubbles. In this embodiment, the air bubbles also communicate with each other through small connecting passageways. The air bubbles in FIG. 5 may be any geometric shape that will fit together in a continuous layer. The shapes could be triangles, rectangles, polygons or any shape that will fit together to make a smooth continuous surface. The embodiment presented in FIG. 5 has no ventilation system. This is due to the design of the air bubbles 38 as there is no space on the side of the air bubbles 38 as there is when the air bubbles 18 in FIG. 1 have a hemispherical shape. This embodiment presented in FIG. 5 also has passageways between each of the air bubbles 38 to equalize the air pressure. The air bubbles 38 will expand and conform to a wearer's head while the air supply is providing pressure through valve means 22. FIG. 5 also shows a ventilated mouthpiece door 26 and a filter 28 which is the same as in FIG. 1 to insure clean air to the mouth/nose area. The door 26 can also be regulated to close out the cold wind or rain.

Figure 6:
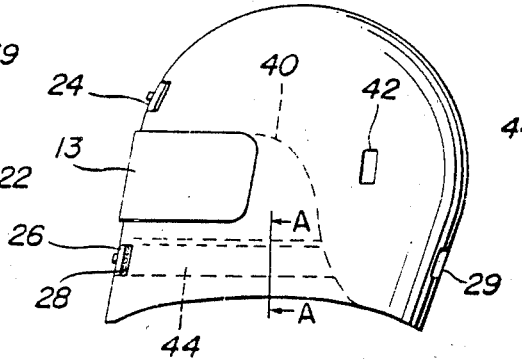
FIG. 6 is a side view of the protective crash helmet showing still another embodiment that employs additional features.

FIG. 6 shows yet another embodiment whose layered construction is identical to helmet 10. The dashed line 40 is the internal outline of the air bubbles 18 shown in the cross section presented in FIG. 1. The additions to the embodiment presented in FIG. 6 is an added outlet 42 on each side and to the rear of the helmet and an added canal 44 to direct part of the air flow around each side of the face which will provide more ventilation to the air bubbles 18. The canal 44 is connected to front ventilated mouth piece door 26. These added features will provide additional ventilation and consequently comfort to a rider who is taking a prolonged ride in a desert like climate.

Figure 7:
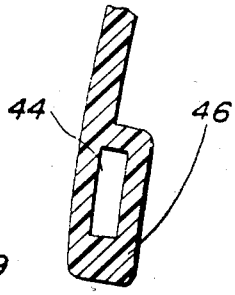
FIG. 7 is a detailed cut-a-way section showing the construction of an air canal.

FIG. 7 is a section A-A of the canal 44 showing the construction on the bottom edge of the helmet described in FIG. 6. The foam material 46 in FIG. 7 is of a closed cell foam construction. Another canal identical to 44 is on the other side (not shown) of the helmet.

It will be readily apparent to those skilled in the art that various modifications and changes can be made without departing from the spirit of the invention. While an operative example of this invention has been described with some particularity, it will be understood that modifications may be made therein within the scope of the following claims.

What is claimed is:

1. A protection crash helmet comprising a rigid outer protective shell;

a first layer of cushioning material secured to the interior of said protective shell;

a second layer of cushioning material secured to the interior of said first layer wherein said second layer is a sheet containing at least 25 hemispherical shaped air cells with the round portion of said hemispherical shaped air cells directed toward the wearer's head with passageways therebetween;

at least one air inlet provided in the frontal area of said helmet to direct air inside of said helmet;

means for distributing said air inside said helmet wherein said means is by flowing through said passageways between said air cells;

at least one air outlet provided in said helmet to let a portion of said air escape from said helmet, and a removable porous liner fitted to the interior of said second layer.

2. A protective crash helmet as described in claim 1 wherein said air cells in said second layers communicate with each other by a tube.

3. A protective crash helmet as described in claim 2 wherein said air cells communication is connected to a valving means.

4. A protective crash helmet as described in claim 3 wherein said valving means holds said air pressure inside said air cells.

5. A protective crash helmet as described in claim 3 wherein said air pressure in said air cells can be varied.

6. A protective crash helmet as described in claim 1 wherein said liner is a thin mesh backed with open cell foam.

7. A protective crash helmet as described in claim 1 further comprising valve means for controlling movement of said air through said inlets.

8. A protective crash helmet as described in claim 7 wherein said valve means is sliding doors on the front of said crash helmet.

* * * * *